United States Patent [19]

Kühner

[11] 4,219,295

[45] Aug. 26, 1980

[54] APPARATUS FOR PARKING MOTOR VEHICLES

[76] Inventor: Ernst E. Kühner, 8 Fère-Champenoise-Strasse 8, D-7501 Bruchhausen, Fed. Rep. of Germany

[21] Appl. No.: 883,154

[22] Filed: Mar. 3, 1978

[30] Foreign Application Priority Data

Mar. 3, 1977 [DE] Fed. Rep. of Germany ..... 2709203

[51] Int. Cl.[2] ..... F04H 6/06

[52] U.S. Cl. ..... 414/242

[58] Field of Search ..... 214/16.1 R, 16.1 A, 214/16.1 E, 16.1 EC, 16.1 ED, 77 P; 414/228, 242, 546, 556–558

[56] References Cited

U.S. PATENT DOCUMENTS

| | | | |
|---|---|---|---|
| 3,369,679 | 2/1968 | Robinson | 214/77 P |
| 3,985,243 | 10/1976 | Kuhner | 214/16.1 R X |

*Primary Examiner*—Robert G. Sheridan

*Attorney, Agent, or Firm*—Craig & Antonelli

[57] ABSTRACT

Apparatus for parking motor vehicles has parking pallets for the vehicles which can be moved individually between lowered and raised positions corresponding respectively to a ground level parking surface and an upper parking level. For holding each pallet in the raised position there is provided a locking arrangement for locking the pallet relative to a support structure. Such locking arrangement includes a co-operable hook and counterpiece which are moved into and out of co-operation with each other by the raising and lowering of the pallet.

5 Claims, 4 Drawing Figures

APPARATUS FOR PARKING MOTOR VEHICLES

In United Kingdom Pat. No. 1,464,499 and corresponding U.S. Pat. No. 3,985,243 apparatus for parking motor vehicles at a second level lying above a ground level parking surface is proposed with the apparatus having a number of parking pallets arranged radially next to one another on a central column. The pallets are rotatable about the column and are movable between the second level and the ground level means of a lifting apparatus, which engages loosely on the underside of the parking pallets. The parking pallets are linked to a supporting structure rotatably mounted on the column via links which guide the pallets between a raised position and a lowered position with each pallet being slightly inclined and displaced inwards at the lowered position relative to the raised position. The parking pallets are lockable in the raised position on the supporting structure and characterised in that the lifting apparatus engages loosely on the underside of the parking pallets.

The aforementioned Patent specifically describes one form of locking means which has bolts which are arranged on the supporting structure or movably on the pallets, which bolts engage in openings on the respective other part. For the operation of the locking means a drive and a control apparatus are necessary with the control apparatus actuating the drive in dependence on the position of the pallet.

The invention is based on the problem of simplifying the locking means while maintaining safety.

With the object of solving this problem, according to the invention the locking means is formed as a suspension apparatus having at least one hook on the parking pallet or the supporting structure and a counterpiece co-operable with the hook opening, the hook and counterpiece alone being capable of being locked and unlocked by the lifting and lowering movement of the pallet concerned.

With the arrangement of the invention the suspension of the pallets in the locking position as well as also the unhooking of the pallets from the locking position may be effected in consequence of the lifting and lowering movement of the pallet. Accordingly, a separate drive and a separate control apparatus which actuates the drive in dependence on the position of the pallet, need not be essential.

In a preferred construction of the invention a pawl is mounted on the hook so as to be pivotable against the force of a spring, which spring urges the pawl to a position defined by a stop at which the hook opening is freed, in which position the hook, upon raising of the pallet, is moved out of co-operation with the counterpiece and the pawl can be raised away from the position defined by the stop to effect closing of the hook opening with the pawl by engagement of the counterpiece with the pawl on a subsequent lowering movement of the pallet. The hook can itself be mounted on one of the pallets and supporting structure so as to be pivotable against the force of a spring which spring presses the hook against a stop while allowing the lifting from the stop, when upon raising of the pallet the hook runs from below onto the counterpiece. The counterpiece, which may be in the form of a bolt, also may be supported resiliently such that upon running onto the outside of the hook it deflects and then falls into the hook opening.

Preferably two such hooks are provided on the front side of the pallet and a counterpiece dimensioned sufficiently long for co-operation with the two hooks is provided on the supporting structure. The arrangement of the locking apparatus on the front side is particularly favourable as hereby the load produced by the pallet is applied at the position radially nearest to the middle axis of the column.

According to a further construction of the invention the counterpiece may be located on a rocker which is supported via a spring on another part, for example, the supporting structure and carries an actuating means for a switch for indicating the locking or unlocking and the loading of a pallet whereby it can be indicated to a user or to an operator which pallet is occupied.

The invention will now be described further by way of example only and with reference to the accompanying drawings in which.

Figure 1:
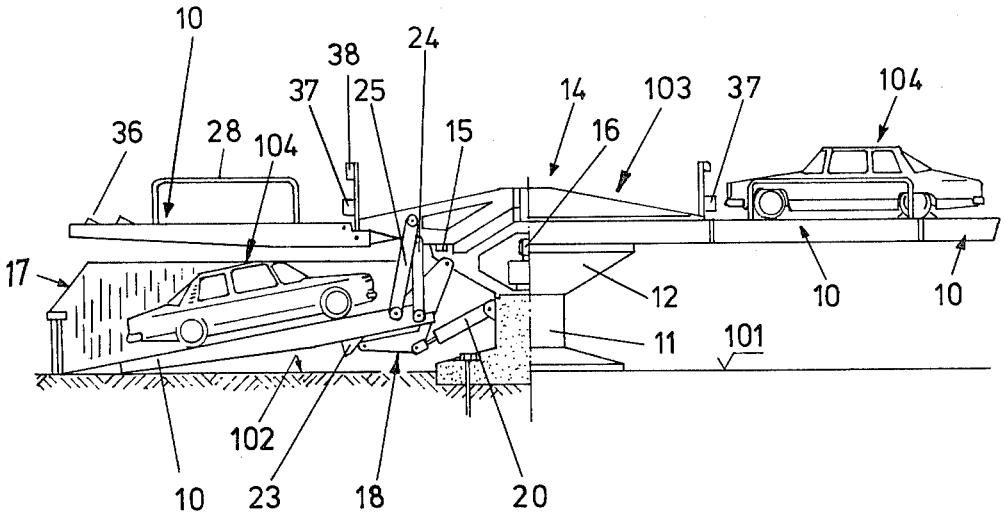
FIG. 1 is a side view partly in section of one form of an apparatus for parking according to the invention.

FIG. 1 shows a ground level parking surface 101, 102, with an apparatus generally designated by the reference numeral 103 thereon with pallets 10 which are dimensioned for receiving motor vehicles generally designated by the reference numeral 104. The pallets generally designated by the reference numeral 10 have an upper position of use as shown at the right side of FIG. 1 at which their clearance above the ground level surface corresponds to the usual vehicle height. The pallets 10 are arranged in a horizontal plane radially around a column 11 and the greatest diameter of the resulting circular pallet arrangement of the pallets 10 extends over the width of the parking strips 101, 102. With the illustrated arrangement there are twelve pallets 10.

The column 11 which is fixed on the ground and for example is a ready-made part made of steel and concrete has a mushroomshaped widened portion 12 which is a steel structure mounted on the column 11 and has a bearing rim 13. Above the mushroomshaped widened portion 12 there is disposed a supporting structure generally designated by the reference numeral 14 constructed likewise of steel which is rotatable by means of rollers 15 on the bearing rim and is derivable, for example, by means of an electric motor. On the supporting structure 14 are arranged radially the pallets 10 which are connected to the structure 14 in the raised position by a locking means described in more detail hereinafter.

At a loading and unloading place 17, which is shown at the left side of FIG. 1, the apparatus 103 has a lifting apparatus generally designated by the reference numeral 18 (see FIG. 2) which may loosely engage on a pallet 10 rotated in the same direction. The lifting apparatus 18 comprises, in the embodiment shown, a lifting piston and cylinder assembly 20 which is hinged to the column 11 and a triangular lifting lever 21 on one corner of which the lifting piston and cylinder assembly 20 is hingedly engaged. The lifting lever 21 is in its turn linked at a further corner to the mushroom-shaped widened portion 12 and has at its third corner a roller 22 which loosely contacts a guide piece 23 on the underside on the pallet 10.

Figure 2:
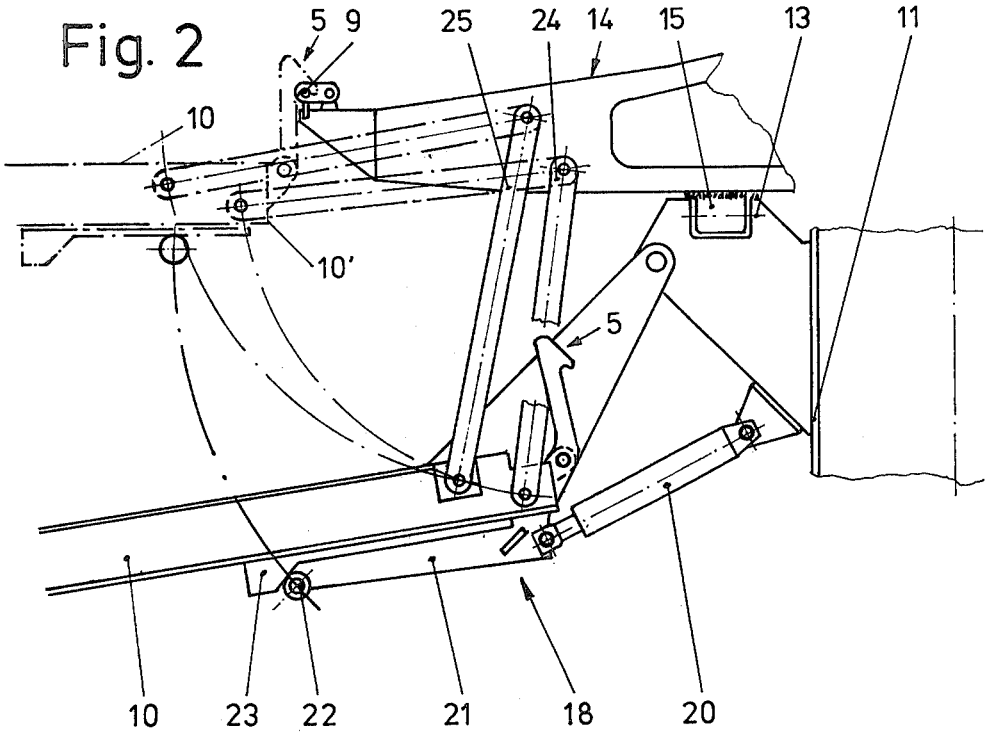
FIG. 2 is a similar view to an enlarged scale of part of the construction shown at the left side of FIG. 1 showing a linking and locking apparatus of a parking pallet on a supporting structure on a central column.

The pallets 10 are connected via two links 24, 25 of different length to the supporting structure 14 and in the raised position are fixed to this by means of the locking apparatus yet to be described. The links 24, 25 engage, as can be seen in FIG. 2, outside the bearing rim 13 on the supporting structure 14 and the position of their engaging points and their length are so selected that the pallet 10 is slightly inclined in the lower position.

The pallets 10 may have parallel recessed channels, not shown. At the rear end of each pallet 10 there may be provided crosswise channels, likewise not shown, so that the driver driving onto the pallet notices when his vehicle is in the correct position. Behind and, if necessary, in front of the crosswise channel there may be provided blocking wedges 36 by means of which a rolling off of the vehicle 104 in particular, during the raising of the pallet, is prevented. On the front end the pallets 10 may have drive-on buffers 37 and a signal lamp 38 coupled therewith which indicates the correct position of the vehicle. Each pallet 10 may furthermore have, on at least one side, a hand rail 28 for the safety of the driver on the pallet 10.

Figure 3:
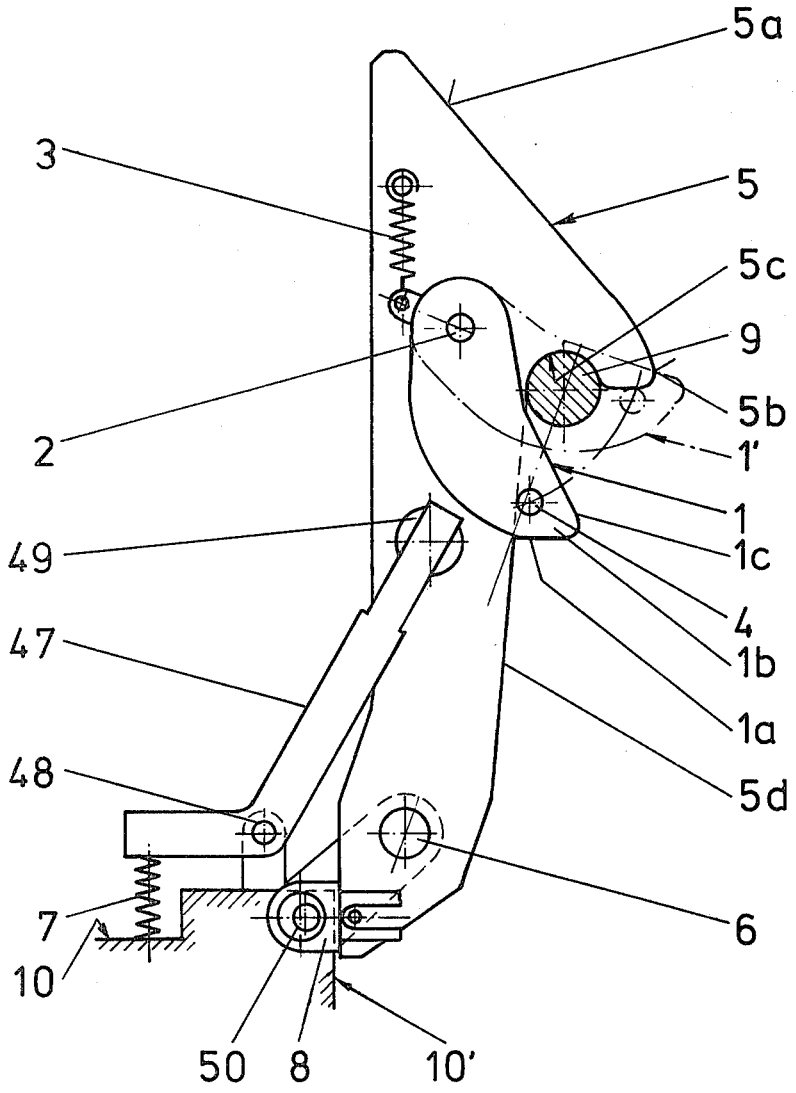
FIG. 3 shows to a further enlarged scale parts of the locking apparatus of FIG. 2.

Each pallet 10 carries on its front side opposite the supporting structure 14 two hooks generally designated by the reference numeral 5 arranged spaced apart which are co-operable with bolts 9 arranged on the supporting structure 14 to define a locking apparatus. FIG. 2 shows at the bottom in full lines the unlocked position and at the top in dot and dash lines the locked position in which the hooks 5 are suspended on the bolts 9. Details of the structure and support of the locking apparatus comprising the hooks 5 and bolts 9 can be seen in FIG. 3 and 4.

Each hook 5 is mounted so as to be pivotable against the force of a compression spring 7 about an axis 6 on the front side generally designated by the reference numeral 10' of the pallet 10. The compression spring 7 acts between the pallet 10 and the hook 5 via an angle lever 47 which is pivotable about an axis 48 on the pallet 10 and with its upper free end is supported via a bolt 49 rotatable in a bore of the hook 5. The compression spring 7 thus tends to urge the hook 5 in the clockwise direction against the stop 8 which is mounted on the pallet 10 adjustable by an eccentric bolt 50.

The hook 5 carries an axle 2 on which a pawl 1 is mounted so as to be pivotable against the force of a traction spring 3. The traction spring 3 tends to draw the pawl 1 against a stop 4 which is formed by a bolt fixed on the pawl and an edge **5*d* of the hook 5 under its round hook opening 5*c*. The pawl 1 is pivotable against the force of the traction spring 3 to the position 1', shown in dot and dash lines, in which the panel 1 covers the hook opening 5*c* and therefore effects locking against the co-operation with the bolt 9**.

The locking apparatus or suspension apparatus described above operates as follows.

In order to suspend the hook 5 and thus the pallet 10 on the bolt 9 the pallet 10 is raised from the position shown in solid lines in FIGS. 1 and 2. The bolt 9 is disposed on the supporting structure 14 at such a position that hook 5 with this raising movement engages with its upper edge **5*a* on the bolt 9 and runs therealong. The hook 5 is hereby pressed away from the stop 8, by means of the bolt 9, against the force of the spring 7 until the bolt 9 has travelled over the hook nose 5*b* whereupon the hook is pivoted back under the action of the spring 7 and engages around the bolt 9 so that this is engaged in the hook opening 5*c*. Thereby the pallet 10** is suspended.

In order to lower the pallet 10 from the parking position the pallet 10 and thus also the hook 5 are first raised a little so that the bolt 9 comes free from the hook opening **5*c* and moves downwards along an edge 1*c* of the pawl 1 until the bolt 9 reaches the nose 1*b* of the pawl 1. The downward movement of the pallet 10 and thereby also of the hook 5 then begin whereby the bolt 9 runs on the underside of 1*a* the pawl 1 and pivots the pawl 1 upwards in the clockwise direction against the action of the traction spring 3 to the position 1'** shown in dot and dash lines.

The pawl 1 now closes or blocks the hook opening **5*c* thereby preventing re-insertion of the bolt 9 in the hook opening 5*c* and causes the bolt 9 to travel around the nose 5*b* of the hook 5. Consequently the hook 5 and the pallet 10** are freed from the bolt.

The suspension as well as also the unhooking of the pallet 10 is effected solely and automatically due to the raising and lowering movement of the pallet without hereby additional drives and control devices being necessary.

Bolt 6 extends, as stated above, over a substantial length and on each pallet 10 there are provided two hooks 5 spaced apart so that the pallet is also secured against tilting in a lateral direction.

Figure 4:
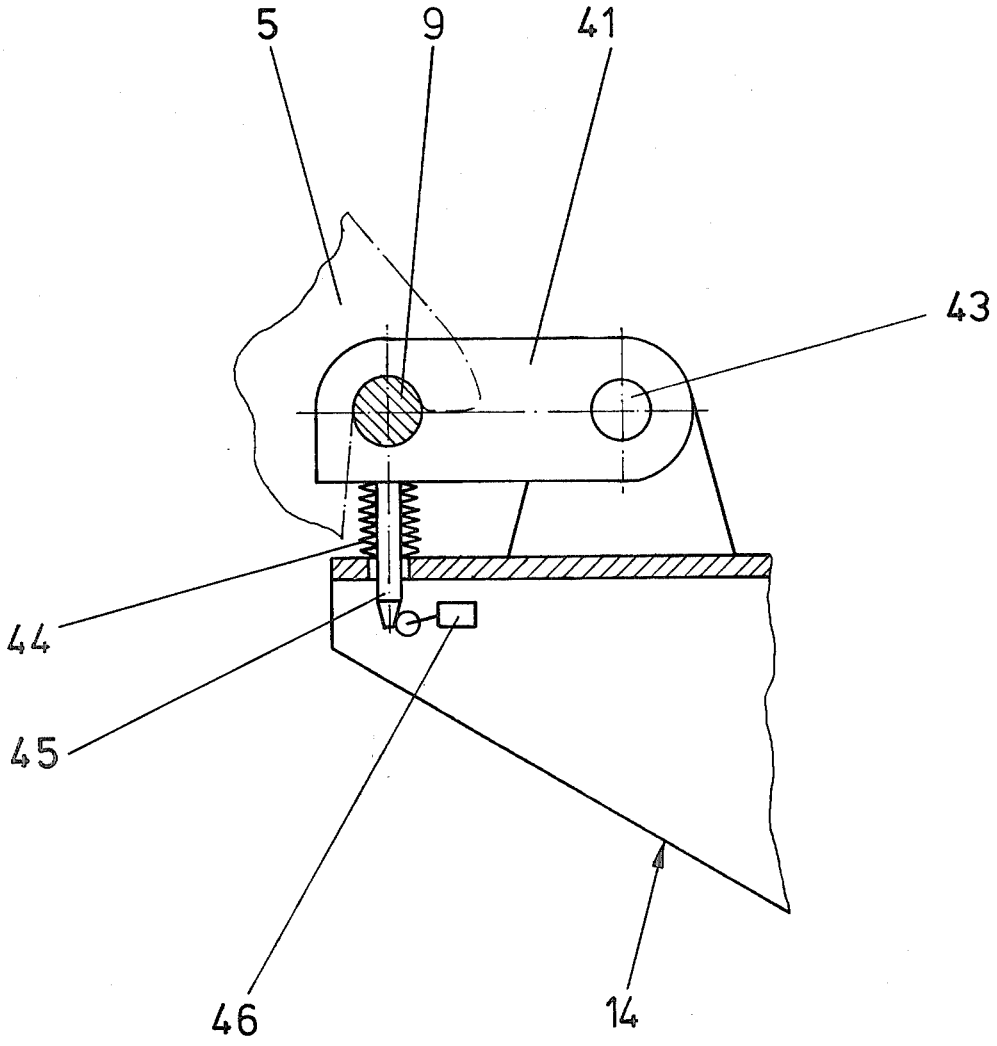
FIG. 4 is a view of the locking apparatus with a preferred form of support for one component thereof.

FIG. 4 shows a preferred arrangement for mounting the bolt 9 on the supporting structure 14. The bolt 9 is located at the free end of a rocker 41 which has a link end pivotably connected to the supporting structure 14 via an axle 43 and which is supported at its free end receiving the bolt 9 via a compression spring which, in the embodiment shown, is a plate spring pack 44, on the supporting structure 14. The rocker 41 has furthermore at its free end an operating pin 45 for a switch 46 which is connected to an indicating circuit. If the load transmitted from the hook 5 to the bolt 9 is, for example, due to a motor vehicle driving onto the pallet 10, so great that the plate spring pack 44 is sufficiently compressed, the operating pin 45 actuates the switch 46 and thereby actuates a "pallet occupied" indicator.

What is claimed is:

1. An apparatus for parking motor vehicles at a second level lying above a ground level parking surface, the apparatus comprising a plurality of parking pallets for accommodating motor vehicles arranged next to one another on a central column and extending radially outwardly relative to the central column, the pallets being rotatable about the central column and being movable between the second level and the ground level by a lifting apparatus which loosely engages an underside of the respective pallets, linked means for interconnecting each of the parking pallets to a supporting structure rotatably mounted on the central column and for guiding the parking pallets between a raised position at the second level and a lowered position at the ground level, each parking pallet being slightly inclined and displaced inwards at the lowered position relative to the raised position, and means for locking each of the parking pallets in the raised position on the supporting structure, characterized in that said locking means includes at least one hook having an opening, the at least one hook is disposed on one of the parking pallets and the supporting structure, a countermember disposed on the other of said parking pallets and supporting structure and cooperating with said hook opening for effecting a locking of the parking pallet in a generally horizontal raised position, means are provided for mounting said hook and said countermember so as to enable the countermember to be moved into and out of the hook opening by the raising and lowering movement of the respective parking pallets, a pawl is pivotally mounted on the hook for controlling access into the hook opening, means are provided for normally urging the pawl into a position at which the pawl is clear of the hook opening, stop means are provided for defining the position at which the pawl is clear of the hook opening, and in that the pawl is mounted on the hook so that, upon raising the parking pallet, the countermember is moved out of the hook opening and cooperates with the pawl so as to raise the pawl from said position defined by said stop means thereby effecting a closing of the hook opening by the pawl through an engagement of the countermember with the pawl during a subsequent lowering movement of the parking pallet.

2. An apparatus according to claim 1, characterized in that said mounting means includes a pivot means for pivotally mounting the hook on one of the parking pallets and supporting structure, stop means are provided for limiting the pivotal movement of the hook, spring means are provided for normally urging the hook towards said last-mentioned stop means, said hook being pivotally mounted so as to permit raising of the hook from the last-mentioned stop means when, upon raising of the parking pallet, the hook runs from below onto the countermember.

3. An apparatus according to claim 2, characterized in that means are provided for enabling an adjusting of the stop means for limiting the pivotal movement of the hook.

4. An apparatus according to claim 1, characterized in that two hooks are provided and are disposed on a front side of the respective parking pallets and, the countermember is dimensioned sufficiently long so as to enable a cooperation between the countermember and the two hooks, and in that the countermember is mounted on the supporting structure.

5. An apparatus according to claim 1, characterized in that the countermember is constructed as a bolt.

* * * * *